US006989850B2

(12) United States Patent
Burdenko

(10) Patent No.: US 6,989,850 B2
(45) Date of Patent: Jan. 24, 2006

(54) THERMAL PRINTER APPARATUS

(75) Inventor: Michael N. Burdenko, Wellesley, MA (US)

(73) Assignee: Polaroid Corporation, Waltham, MA (US)

( * ) Notice: Subject to any disclaimer, the term of this patent is extended or adjusted under 35 U.S.C. 154(b) by 0 days.

(21) Appl. No.: 10/743,351

(22) Filed: Dec. 22, 2003

(65) Prior Publication Data

US 2004/0135873 A1 Jul. 15, 2004

Related U.S. Application Data

(60) Provisional application No. 60/436,278, filed on Dec. 23, 2002.

(51) Int. Cl.
*B41J 11/04* (2006.01)

(52) U.S. Cl. ..... 347/220; 400/82; 400/648; 400/649

(58) Field of Classification Search ..... 347/220; 400/82, 691, 648, 649
See application file for complete search history.

(56) References Cited

U.S. PATENT DOCUMENTS 5,132,704 A 7/1992 Nakagawa ..... 346/76 PH
5,138,336 A * 8/1992 Goto ..... 347/198

FOREIGN PATENT DOCUMENTS

EP 0 589 714 A2 3/1994
JP 63 098451 4/1988

* cited by examiner

*Primary Examiner*—Huan Tran

(57) ABSTRACT

There is described a thermal printer apparatus including one or more thermal print heads fixedly mounted with respect to a print media path, one or more platen roller assemblies each including a platen roller adapted to press print media in the print media path against at least one print head and a frame adapted to support a respective platen roller and a pivotally mounted support member adapted for mounting the platen roller assembly frames to extend from the support member and press its respective platen roller against the print head.

10 Claims, 6 Drawing Sheets

THERMAL PRINTER APPARATUS

REFERENCE TO RELATED APPLICATIONS

This application claims the benefit of provisional application Ser. No. 60/436,278, filed Dec. 23, 2002.

This application is related to commonly assigned U.S. patent application Ser. No. 10/743,235, filed on even date herewith the entire disclosure of which is hereby incorporated by reference herein.

TECHNICAL FIELD

The present invention relates to thermal print head assemblies in which a platen roller is moveably mounted for pressuring print media against a fixedly mounted print head.

BACKGROUND OF THE INVENTION

Modern thermal print heads have achieved levels of resolution based upon integrated circuit construction techniques which can locate a great number of individual heating elements in close proximity to each other. This advantage of resolution creates a limitation on the total span of the print head due to the possibility of faults occurring in the semiconductor, both in the manufacturing process and later in the printing application. Larger print spans have been achieved by aligning two or more smaller print heads to achieve the wider span. Also, due to the resolution achieved, relatively small misalignment between such multiple print heads are easily noticed in the resulting printed product. Even misalignments of as little as one pixel can be visually determined.

The construction and accuracy of multiple thermal print head alignment is further challenged by the need to substantial squeeze the print media against the thermal print head to provide good thermal conductivity.

SUMMARY OF THE INVENTION

The present invention relates to a thermal printer apparatus, including one or more thermal print heads fixedly mounted with respect to a print media path, one or more platen roller assemblies each including a platen roller adapted to press print media in the print media path against at least one of the print heads and a frame adapted to support a respective platen roller, and a pivotally mounted support member adapted for mounting the platen roller assembly frames to extend from the support member and press its respective platen roller against the thermal print heads.

The support member may be adapted to pivot with respect to an imaginary plane defined by the platen rollers mounted to the support member. The platen rollers may include a rotational axis, and the support member may be adapted to pivot in an imaginary plane defined by all of the axes of the platen rollers. Alternatively, the support member may be adapted to pivot the platen rollers in an arc while the platen assembly frames remain tangential to the arc.

The apparatus may further include a plurality of parallel platen roller assemblies, wherein the platen rollers of the plurality of platen roller assemblies define an imaginary plane, and further wherein the frame is adapted to pivot with respect to the imaginary plane. The apparatus may also include one or more second thermal print heads fixedly mounted with respect to the print media path, wherein the second thermal print heads are located in close proximity to the first thermal print heads.

The apparatus may further include one or more second platen roller assemblies each including a platen roller adapted to press print media in the print media path against at least one of the second thermal print heads and a frame adapted to support a respective platen roller, and a pivotally mounted second support member adapted for mounting the second platen roller assembly frames to extend from the second support member and press its respective platen roller against the second thermal print heads. The first and second thermal print heads may be fixedly mounted with respect to the print media path by a unified structure. The first thermal print heads may be fixedly mounted to print from one side of the print media path, and the second thermal print heads may be fixedly mounted to print from an opposing side of the print media path. The first thermal print heads may be mounted on a first subframe section and the second thermal print heads may be mounted on a second subframe section, and the first platen roller assemblies may be adapted to extend through the second subframe section to contact the first thermal print heads and the second platen roller assemblies may be adapted to extend through the first subframe section to contact the second thermal print heads.

These variations better enable the use of fixed thermal print heads while providing a convenient and effective apparatus.

BRIEF DESCRIPTION OF THE DRAWINGS

For a better understanding of the invention as well as other objects and further features thereof, reference is made to the following detailed description of various preferred embodiments thereof taken in conjunction with the accompanying drawings wherein.

DESCRIPTION OF THE PREFERRED EMBODIMENTS

Figure 1:
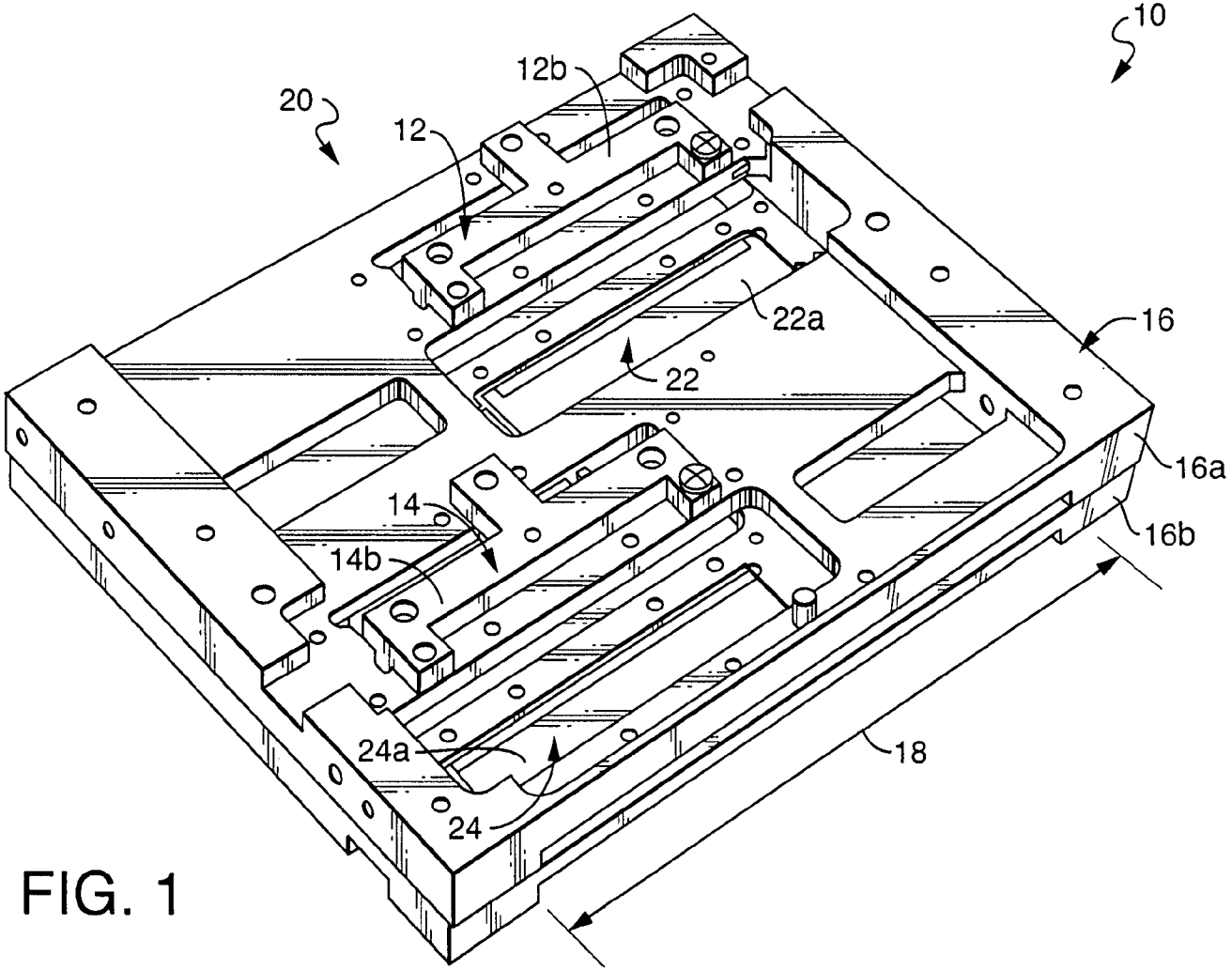
FIG. 1 is a perspective view of one side of a thermal print head assembly according to the invention.

FIG. 1 shows a thermal print head assembly 10 generally including a plurality of elongated thermal print heads 12 and 14 and a frame 16. Frame 16 mounts print heads 12 and 14 to print across a print media path 18 with print heads 12 and 14 being oriented in parallel and orthogonally to the direction of print media movement indicated by arrows 20.

Figure 2:
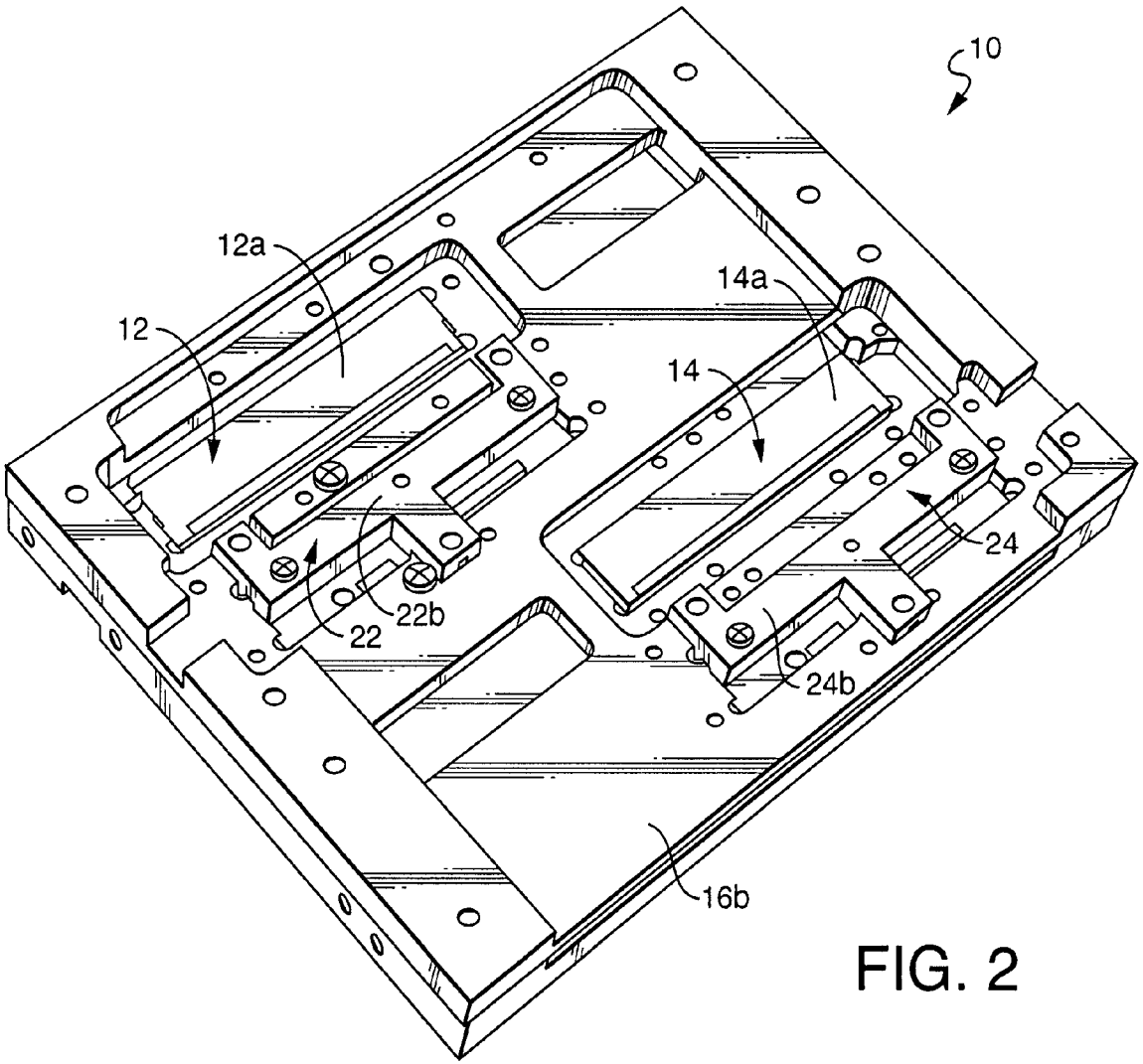
FIG. 2 is a perspective view of the other side of the assembly of FIG. 1.

Frame 16 is provided in two complementary sections 16*a*, 16*b* with section 16*a* mounting print heads 12 and 14 and section 16*b* mounting an additional plurality of print heads 22 and 24. For the purpose of this disclosure, print heads 12, 14, 22 and 24 necessarily include a semiconductor portion, 22*a* and 24*a* shown for print heads 22 and 24 and a holder portion, 12*b* and 14*b* shown for print heads 12 and 14. The semiconductor portions are the printing side of the print heads and include hundreds of semiconductor heating elements formed per linear inch of the elongated semiconductor elements. FIG. 2 shows the opposite side of assembly 10 and the respective opposite sides of print heads 12, 22, 14 and 24.

By this arrangement frame 16*a* positions print heads 12 and 14 to print across substantially different lateral portions of print media path 18. Each of the thermal print heads is positioned to print at a different sequential location along print media path 18 in the direction 20. Print heads 12 and 14 and 22 and 24 are shown to be elongated with an identifiable print length and frame 16 positions print heads 12, 14, 22 and 24 across the width of print media path 18, which width is substantially equal to the total of the printing lengths of either plurality of print heads 12 and 14 or 22 and 24.

Figure 3:
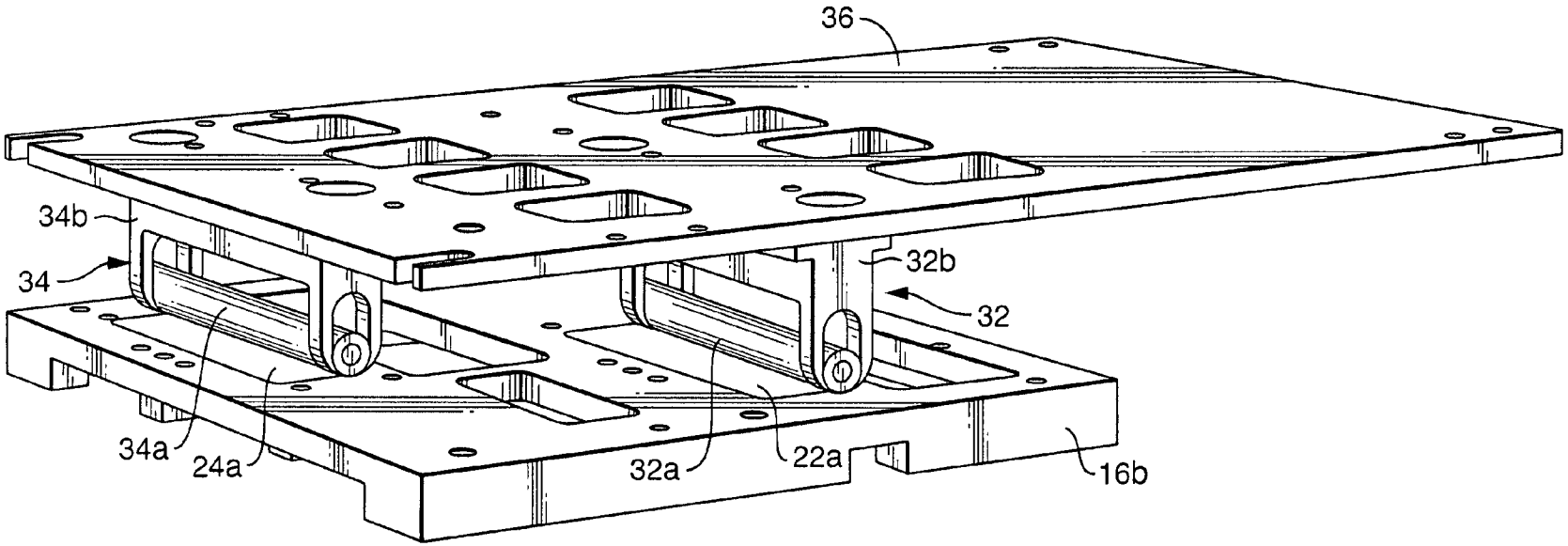
FIG. 3 is a perspective view of a portion of the assembly of FIGS. 1 and 2 in combination with an additional printer component.

FIG. 3 shows frame section 16*b* of assembly 10 (FIG. 1) in combination with a pair of platen roller assemblies 32 and 34 being mounted on a support member 36. Each platen roller assembly 32 and 34 includes a platen roller 32*a*, 34*a* and a mounting frame 32*b*, 34*b*, respectively. Platen rollers 32*a* and 34*a* are aligned with the semiconductor surfaces 22*a* and 24*a* of respective print heads 22 and 24 (FIGS. 1 and 2) in a position for biasing print media located there between against the respective print heads 22 and 24. Platen rollers 32*a* and 34*a* are approximately as long as, or only slightly longer than, the printing length of print heads 22 and 24, and platen rollers 32*a* and 34*a* are further each spring biased from their respective mounting frames 32*b*, 34*b* for allowing rollers 32*a*, 34*a* to conform as necessary to their respective print heads 22, 24. Frame section 16*a* is not present in FIG. 3 for purposes of clarity in showing the interaction between print heads 22 and 24 and platen roller assemblies 32 and 34.

Platen roller assemblies 32 and 34 can each be a platen roller assembly such as is disclosed and claimed in commonly assigned U.S. patent application Ser. No. 10/743,235, filed on even date herewith, the entire disclosure of which is hereby incorporated by reference herein.

Whereas, existing thermal printers mount multiple print heads along a single platen roller, the present application of individual platen rollers to each separate print head provides a better interface function between the platen roller and print head to control thermal contact between print media and the print heads.

Figure 4:
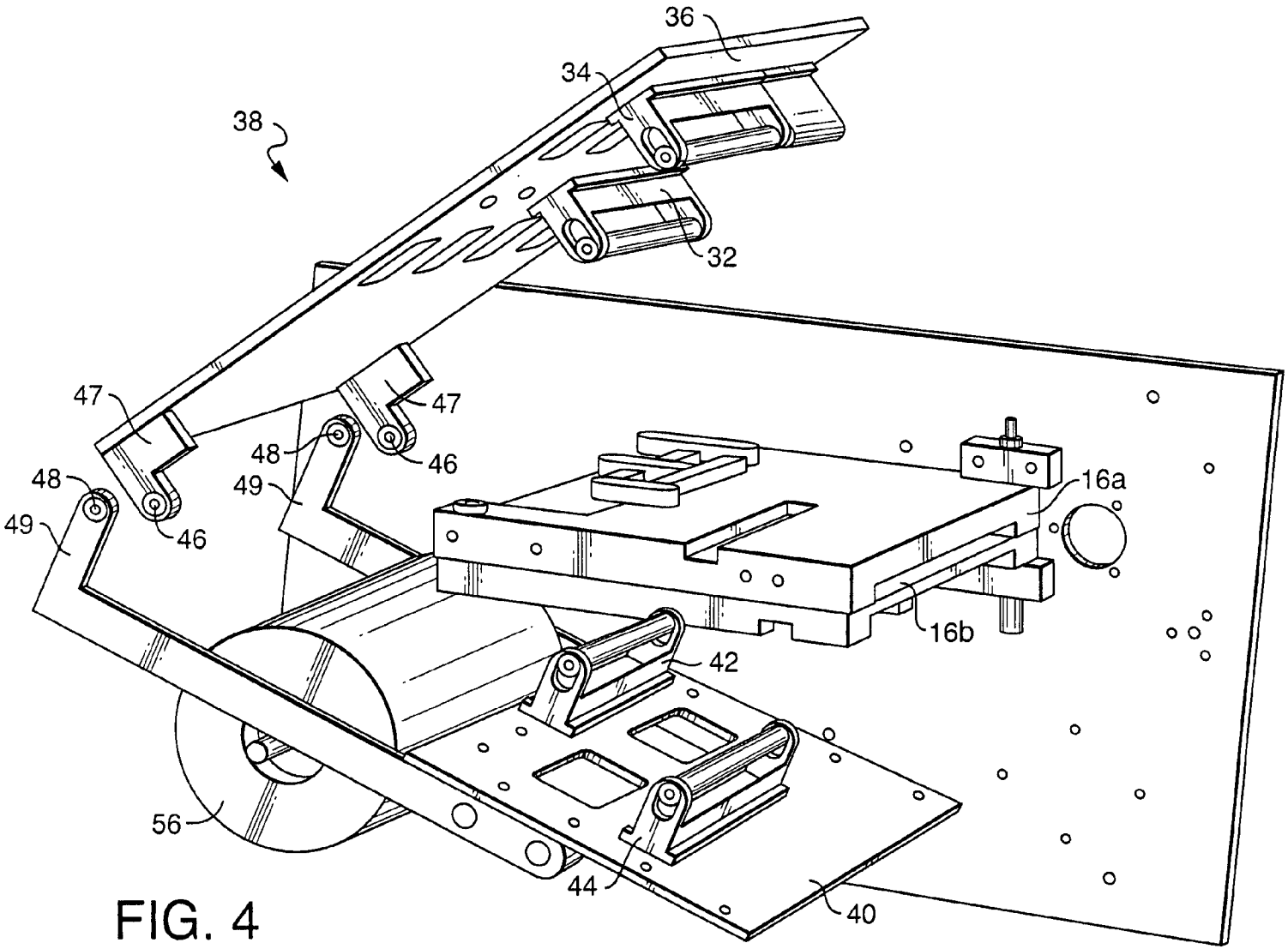
FIG. 4 is a perspective view of a thermal printer apparatus which includes the components described in reference to FIGS. 1–3.

This fixed attachment of print heads uses a unique apparatus for engaging the respective platen rollers with the print heads. FIG. 4 shows a thermal printer apparatus 38 including frame 16, support member 36 and platen roller assemblies 32 and 34. Also shown is a separate support member 40 which mounts platen roller assemblies 42 and 44 to interface with print heads 12 and 14, respectively, on frame section 16*a*. Each of the separate support members 36 and 40 is pivotally mounted at respective locations 46 and 48 by a pair of orthogonal, or "L" shaped, support member extensions 47 and 49, respectively. These orthogonal support member extensions 47 and 49 cause the their respective support members 36 and 40 to rotate around respective axes at pivot points 46 and 48, which axes lie in the same imaginary planes as the axis of rotation the platen rollers mounted from the respective support member.

It can be seen that the pivotally mounted platen roller support allows for a simple loading mechanism when a plurality of platen rollers are loaded simultaneously and sequentially to prevent media "bagging" and/or "wrinkling". It will be appreciated by those skilled in the art that the respective platen rollers contact the media sequentially because the respective platen rollers are located at different distances from the pivot point.

The platen rollers and the print heads can be arranged substantially in line with one another or in overlapping arrangement across the print media path. Further, the print heads can be located on one side or both sides of the media.

Figure 5:
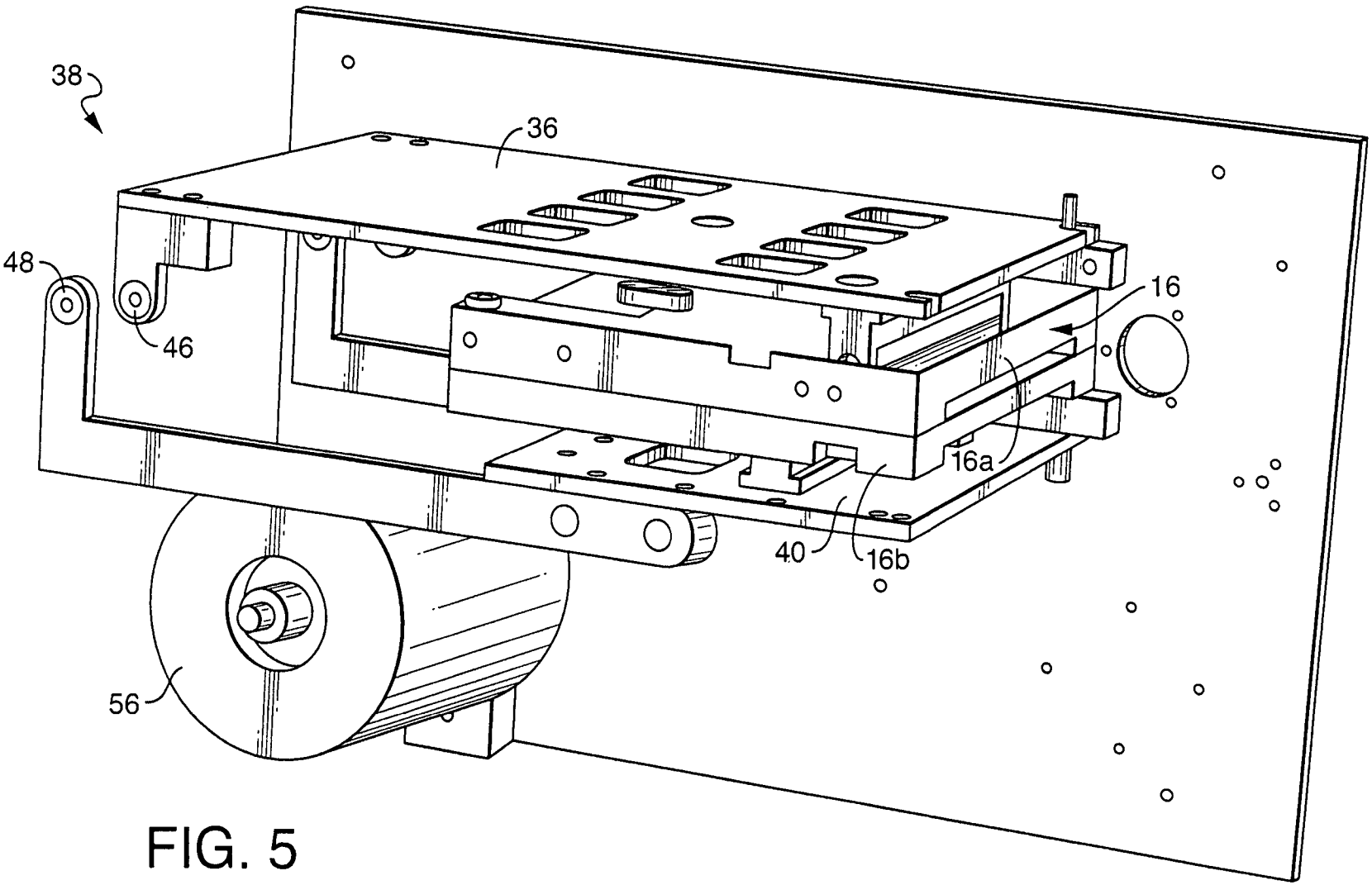
FIG. 5 is another perspective view of the apparatus of FIG. 4.

FIG. 5 shows a perspective view wherein support members 36 and 40 are pivoted into position to make contact between the respective print heads and platen rollers. It demonstrates how platen roller assembly 34 extends through frame section 16*a* to the thermal printer head 24 (FIGS. 1–3) mounted on frame section 16*b*. Platen rollers 42, 44, 32 and 34 are positioned on their respective support members 40, 36 interfacing with alignment with their respective print heads 12, 14, 22 and 24. In order to adequately perform this alignment, support members 36, 40 rotate platen roller assemblies 32, 34, 42 and 44 to extend through opposite respective frame sections 16*a* and 16*b* and interface with the thermal print heads 22, 24, 12, 14, respectively.

Figure 6:
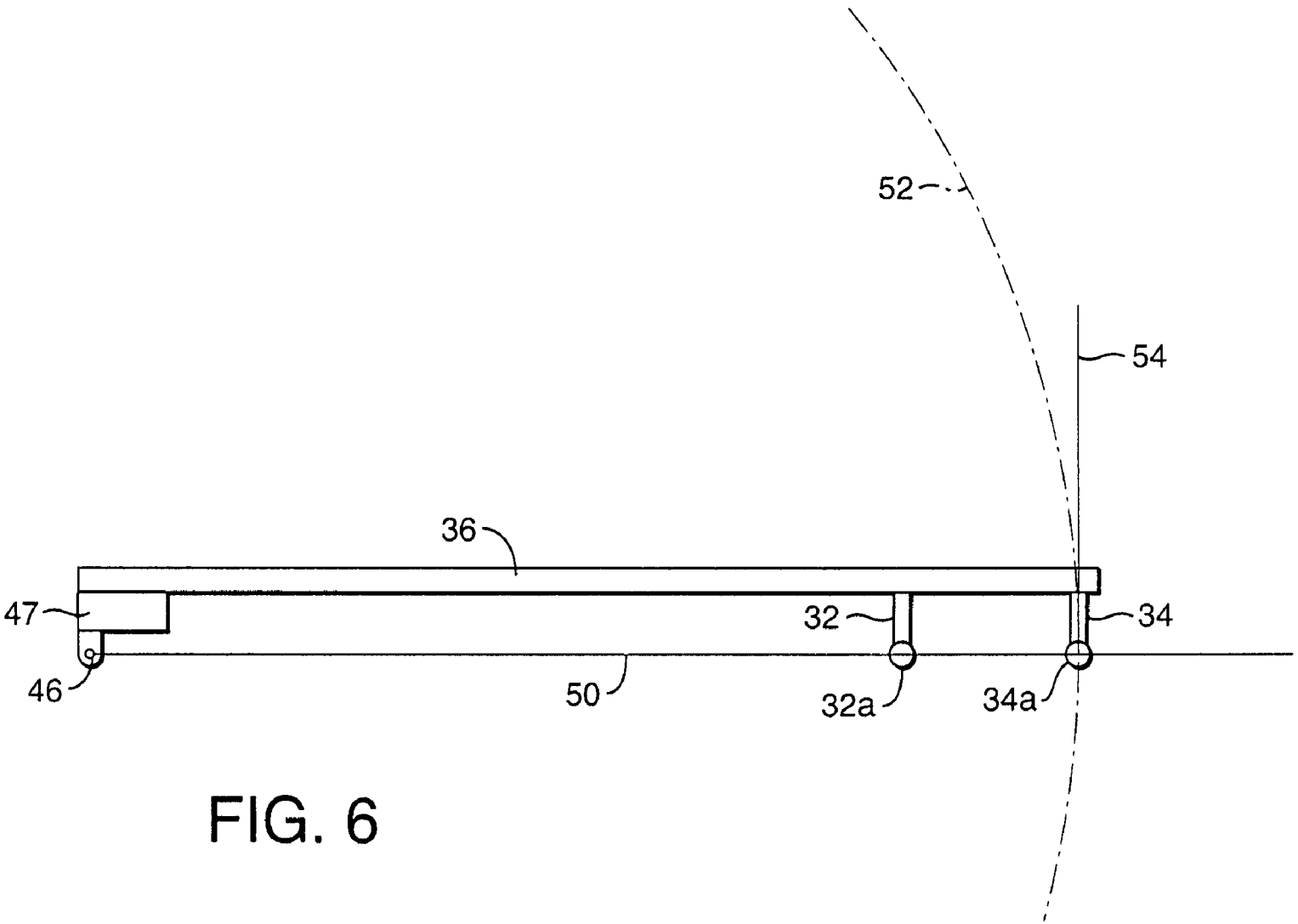
FIG. 6 is a side view of some of the components of FIG. 3.

FIG. 6 shows a side view of support member 36 and roller assemblies 32 and 34. The orthogonal extensions 47 and 49 cause their respective support members 36 and 40 to rotate about pivot points 46 and 48, respectively, which are aligned in the imaginary plane 50 defined by respective platen rollers 32*a*, 34*a*, 42*a* and 44*a*. In this manner, platen rollers 32*a*, 34*a*, 42*a* and 44*a* each defines a rotational arc (52 for platen roller 34*a*) and the respective platen roller frames (34*b*) are maintained at a tangent (54) to each arc. This enables platen roller assemblies 32, 34, 42 and 44 to pass through their respectively opposite frame sections 16*a* and 16*b* in alignment with the respective print heads 22, 24, 12 and 14, without interfering with any portions of the respective opposite frame member 16*a*, 16*b*.

The arrangement of pivot points 46 and 48 being substantially located in an imaginary plane defined by the axes of the respective platen rollers, has an added benefit of providing sequential loading of the print media as the platen rollers are moved into the printing position of FIG. 5 by their respective support members 36 and 40. Specifically, as support member 36 (FIG. 6) is moved into the printing position of FIG. 5, platen roller 32*a* makes contact with the print media prior to platen roller 34*a*. This sequential loading of the print media reduces print media tensioning problems which can occur.

Although FIGS. 4 and 5 show different pivot points 46 and 48 for support members 36, 40, the benefits of the present arrangement may be derived by using the same pivot point for both support members 36, 40. In this refinement, the rotational axis of support members 36, 40 is very closely aligned with the imaginary plane 50 defined by the platen rollers and thus provides the benefits described above in a simplified structure.

Thus, platen roller assemblies 32, 34, 42 and 44 may be readily removed from frame 16 to allow the loading of print media 56 through the print media path of frame 16 and to further readily enable any maintenance and cleaning of the print heads.

Although the invention has been described in detail with respect to various preferred embodiments thereof, it will be recognized by those skilled in the art that the invention is not limited thereto but rather that variations and modifications can be made therein which are within the spirit of the invention and the scope of the amended claims.

What is claimed is:

1. A thermal printer apparatus, comprising:

one or more first thermal print heads fixedly mounted with respect to a print media path;

one or more first platen roller assemblies each including a platen roller adapted to press print media located in said print media path against at least one of said one or more first thermal print heads and a platen roller mounting frame adapted to support a respective one of said one or more first platen rollers; and a pivotally mounted first support member adapted for mounting at least one of said one or more first platen roller assemblies to extend from said support member and press at least one of said one or more first platen rollers against at least one of said one or more first thermal print heads.

2. The apparatus of claim 1, wherein said first support member is adapted to pivot in an imaginary plane defined by said one or more first platen rollers mounted to said first support member.

3. The apparatus of claim 2 wherein said first support member includes a plurality of platen roller assemblies mounted thereto, wherein each of said plurality of platen rollers of said plurality of platen roller assemblies includes a rotational axis, and further wherein said first support member is adapted to pivot in an imaginary plane defined by all of the axes of said plurality of platen rollers.

4. The apparatus of claim 1, wherein said said first support member is adapted to pivot said one or more first platen rollers in an arc and said platen roller mounting frames remain tangential to said arc.

5. The apparatus of claim 1, wherein said first support member includes a plurality of parallel platen roller assemblies, wherein said platen rollers of said plurality of platen roller assemblies define an imaginary plane, and further wherein said first support member is adapted to pivot about an axis which lies in said imaginary plane.

6. The apparatus of claim 1, further comprising, one or more second thermal print heads fixedly mounted with respect to said print media path, wherein said one or more second thermal print heads are located in close proximity to said first thermal print heads.

7. The apparatus of claim 6, further comprising:

one or more second platen roller assemblies each including a platen roller adapted to press print media located in said print media path against at least one of said one or more second thermal print heads and a platen roller mounting frame adapted to support a respective one of said one or more second platen rollers; and a pivotally mounted second support member adapted for mounting at least one of said one or more second platen roller assemblies to extend from said second support member and press at least one of said one or more second platen rollers against at least one or more of said second thermal print heads.

8. The apparatus of claim 7, wherein said first thermal print heads and said second thermal print heads are fixedly mounted with respect to said print media path by a unified structure.

9. The apparatus of claim 8, wherein said first thermal print heads are fixedly mounted to print from one side of said print media path, and said second thermal print heads are fixedly mounted to print from an opposing side of said print media path.

10. The apparatus of claim 9, wherein said first thermal print heads are mounted on a first subframe section of said unified structure and said second thermal print heads are mounted on a second subframe section of said unified structure, and further wherein said first platen roller assemblies are adapted to extend through said second subframe section to contact said first thermal print heads and said second platen roller assemblies are adapted to extend through said first subframe section to contact said second thermal print heads.

* * * * *